US006758079B2

(12) United States Patent
Wells et al.

(10) Patent No.: US 6,758,079 B2
(45) Date of Patent: Jul. 6, 2004

(54) COIL SPRING FORMING MACHINE

(75) Inventors: David Scott Wells, Pleasant Prairie, WI (US); George T. Vattakattu, Deerfield, IL (US)

(73) Assignee: Frank L. Wells Company, Kenosha, WI (US)

( * ) Notice: Subject to any disclaimer, the term of this patent is extended or adjusted under 35 U.S.C. 154(b) by 0 days.

(21) Appl. No.: 09/885,305

(22) Filed: Jun. 20, 2001

(65) Prior Publication Data

US 2002/0194893 A1 Dec. 26, 2002

(51) Int. Cl.[7] ..... B21F 3/10; B21F 3/02

(52) U.S. Cl. ..... 72/138; 72/135; 72/140; 72/143; 140/3 CA

(58) Field of Search ..... 72/138, 143, 452.7, 72/452.6, 140, 129, 135; 140/3 CA; 27/605

(56) References Cited

U.S. PATENT DOCUMENTS 2,077,243 A * 4/1937 Leal ..... 140/79
3,342,052 A * 9/1967 Boy ..... 72/138
3,740,984 A * 6/1973 Bergevin ..... 72/131
3,888,479 A * 6/1975 Eder et al. ..... 271/118
4,509,352 A * 4/1985 Frei ..... 72/138
6,584,823 B2 * 7/2003 Hresc et al. ..... 72/129

* cited by examiner

*Primary Examiner*—John Geotz
(74) *Attorney, Agent, or Firm*—Boyle Fredrickson Newholm Stein & Gratz S.C.

(57) ABSTRACT

A coil spring forming machine for forming a coil spring having a dimensional characteristic, such as a coil diameter and a coil pitch, includes a frame, a control tool movably mounted on the frame, and a control mechanism mounted on the frame and coupled to the control tool. The control mechanism is operable to move the control tool to vary the dimensional characteristic. The control mechanism includes first and second cam surfaces and a cam follower assembly selectively engageable with either of the first and second cam surfaces to vary the dimensional characteristic depending on which cam surface is engaged.

21 Claims, 3 Drawing Sheets

COIL SPRING FORMING MACHINE

FIELD OF THE INVENTION

The invention relates to machines for forming coil springs, and more particularly to coil spring forming machines that are capable of varying the diameter and pitch between consecutively produced coil springs.

BACKGROUND OF THE INVENTION

Demand for posturized spring coil assemblies has grown over recent years. Posturized coil spring assemblies are assemblies that are constructed with a plurality of different coil springs strategically positioned within the assembly. Unlike homogenous coil spring assemblies that have substantially uniform characteristics across the entire assembly, posturized coil spring assemblies offer the ability to change the characteristics of the coil spring assembly to more comfortably support the end user.

The ability to rapidly and efficiently produce posturized coil spring assemblies has resulted in improvements to coil forming machines. Prior to the demand for posturized assemblies, coil forming machines were designed to rapidly produce a single make of coil spring. Typically, the diameter and pitch of the coil spring were controlled mechanically using respective diameter control and pitch control cam/follower arrangements. During operation of the forming machine, the cam/follower arrangements limited the output to a single coil spring design. Only by replacing the cams between production runs could the coil spring design be varied. Replacing the cams was a time-consuming task. As such, these coil spring forming machines were not well-suited for the rapid production of the different coil springs used in posturized coil spring assemblies.

Servo-motors provided the means necessary to design coil forming machines capable of producing different coil springs during a single production run. The servo-motors replaced the cam/follower arrangements and provided the ability to quickly and accurately adjust the diameter control and pitch control mechanisms so that the forming machine could produce different coil springs throughout a single production run. Along with the sevo-motors came the need for new control systems that enabled the rapid production of different coil springs. Examples of coil forming machines using servo-motors, and thereby being capable of producing multiple coil spring designs in a single production run, are found in the following U.S. Patents:

- U.S. Pat. No. 5,950,473 (Andrea et al.) issued Sep. 14, 1999
- U.S. Pat. No. 5,713,115 (Knoepfel et al.) issued Feb. 3, 1998
- U.S. Pat. No. 4,112,721 (Takase et al.) issued Sep. 12, 1978

SUMMARY OF THE INVENTION

While servo-motors were the logical choice for providing the variability required of the forming machines, they have also proven to be somewhat problematic. First, the servo-motors are relatively expensive and add to the cost of manufacturing the forming machine. Second, the elaborate control systems required to drive the servo-motors are also expensive to implement. Additionally, the added control systems further complicate the already complex coil forming machine and present yet another opportunity for timing errors, breakdowns, or failures.

The present invention eliminates the above-identified problems by providing a coil forming machine that is capable of varying the design of the coil springs during a production run without the use of servo-motors. The coil forming machine of the present invention utilizes a mechanical cam/follower arrangement having two or more cam surfaces for variably and selectively controlling the diameter control and/or the pitch control functions of the forming machine. By using the improved cam/follower arrangement, the forming machine of the present invention is less expensive to manufacture and assemble than prior art servo-driven forming machines, and provides a more robust system that decreases the number of timing errors, breakdowns, and unscheduled maintenance operations occurring over the operating life of the machine.

Other features and advantages of the invention will become apparent to those skilled in the art upon review of the following detailed description, claims, and drawings.

Figure 2:
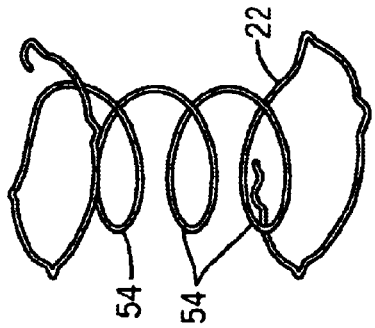
FIG. 2 is a perspective view of a coil spring created by the coil spring forming machine of FIG. 1.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 1:
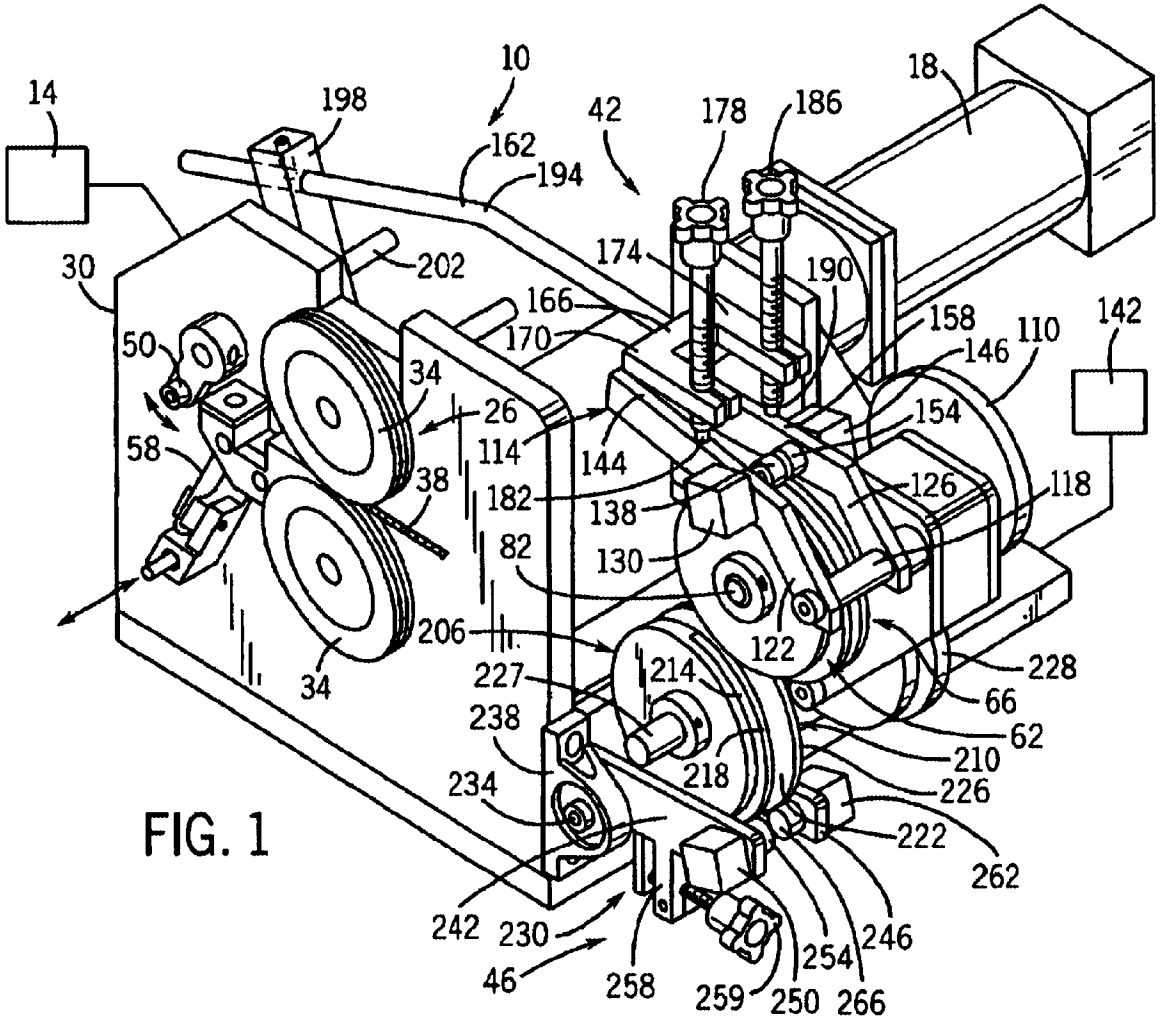
FIG. 1 is a perspective view of a portion of a coil spring forming machine embodying the invention.

FIG. 1 illustrates a portion of the coil spring forming machine 10 embodying the invention. The coil spring forming machine 10 includes a main forming machine driving device 14 (shown schematically in FIG. 1) and a wire feed driving device 18, both of which are suitably mounted on the coil spring forming machine 10 and which are operative, upon each energization thereof, to cause actuation of the coil spring forming machine 10 through one operational cycle. Each operational cycle results in the formation of a single coil spring 22 (see FIG. 2). Of course, other types of coil springs (e.g., round, knotted coil springs) can also be formed. Any suitable driving devices, including commercially available rotary servo-motors or commercially available motors can be used for the main forming machine driving device 14 and the wire feed driving device 18. In the preferred embodiment the main forming machine driving device 14 is a variable speed motor while the wire feed driving device 18 is a rotary servo-motor.

The wire feed driving device 18 drives a wire feed advancing mechanism 26 that is suitably mounted on the frame 30 of the coil spring forming machine 10. The wire feed advancing mechanism 26 includes a pair of feed rollers 34 which are operative to incrementally advance a wire 38 from which the coil springs 22 are formed. The wire feed driving device 18 is capable of varying the length of the wire fed to account for changes in coil pitch and coil diameter as described below. The wire feed advancing mechanism 26 is of a known construction and will not be described in greater detail.

The main forming machine driving device 14 controls energization of a diameter control mechanism 42 and a pitch control mechanism or spreader 46. The diameter control mechanism 42 includes a diameter control tool 50 that controls the diameter of the coil spring 22 being formed. The term "diameter" as used herein and in the appended claims to describe the coil spring 22, is commonly understood and refers to the diameter of the individual winds 54 of the coil spring 22 as seen in FIG. 2. The pitch control mechanism 46 includes a pitch control tool 58 that controls the pitch of the coil spring 22 being formed. The term "pitch" as used herein and in the appended claims to describe the coil spring 22, is commonly understood and refers to the distance between the individual winds 54. The pitch and the diameter of the coil spring 22 are two of the "dimensional characteristics" of the coil spring 22 that can be varied to vary the mechanical characteristics and properties of the coil spring 22.

The spring coil forming machine 10 of the present invention is operable to form two or more different coil springs 22 during an operational run. The spring coil forming machine 10 can achieve this flexibility without the use of independent servo-motors driving each of the diameter control mechanism 42 and the pitch control mechanism 46. Rather, the single main forming machine driving device 14 is the only driving device needed to operate both the diameter control mechanism 42 and the pitch control mechanism 46.

Figure 3:
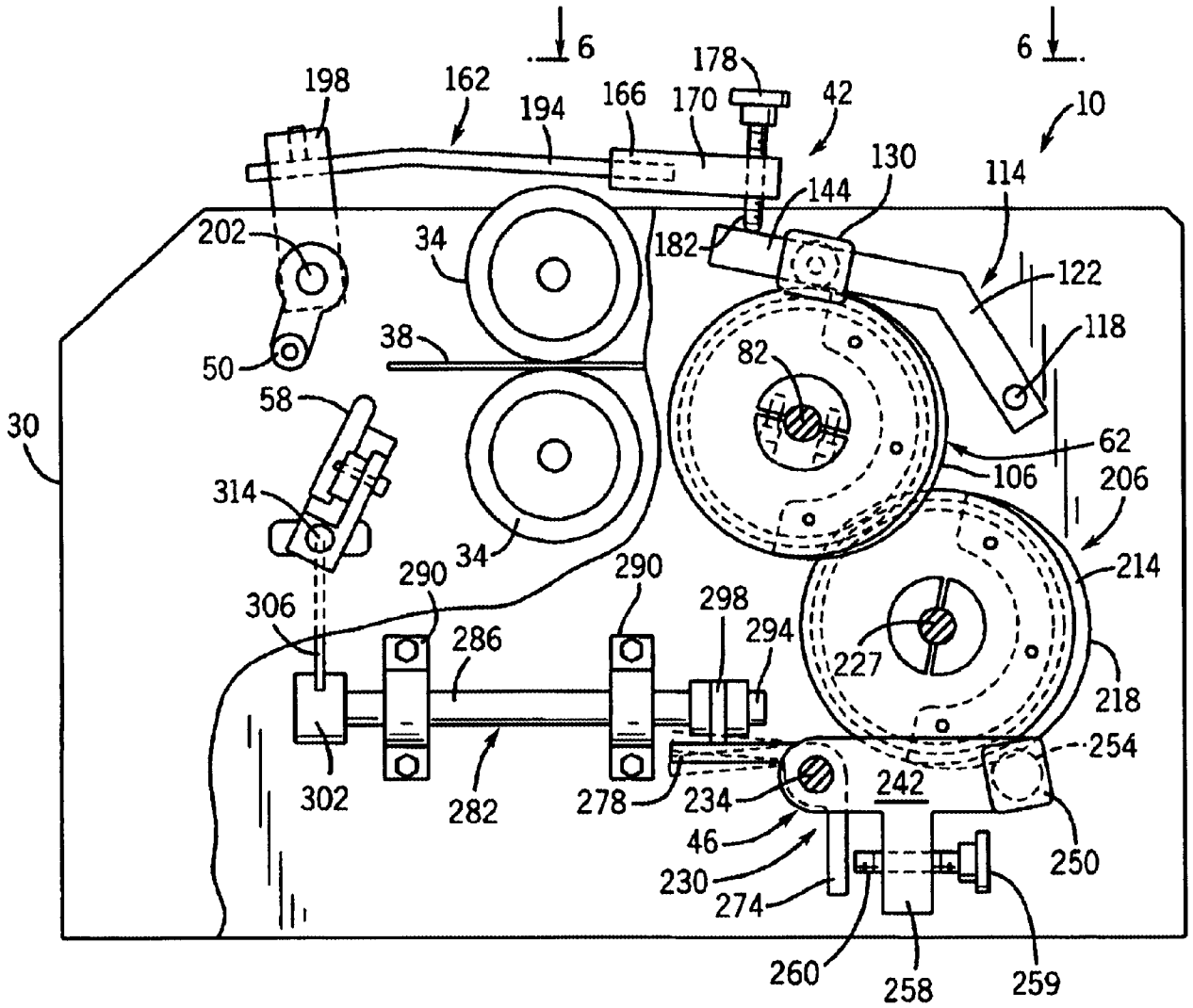
FIG. 3 is a side view, partially cut-away, of the coil spring forming machine of FIG. 1.
Figure 5:
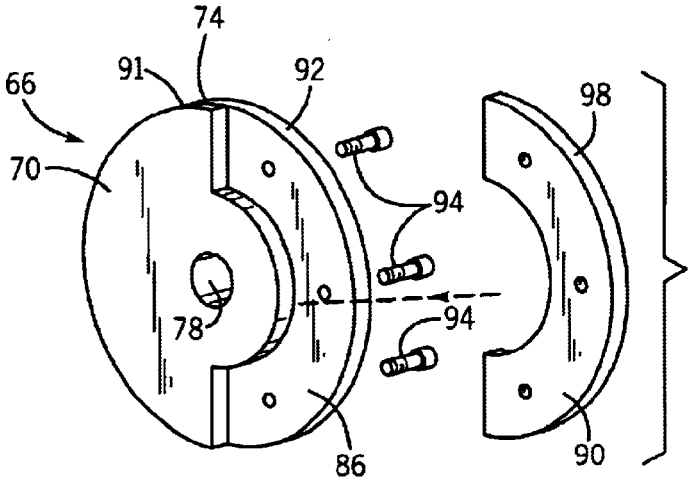
FIG. 5 is an exploded view of a cam disk assembly.
Figure 6:
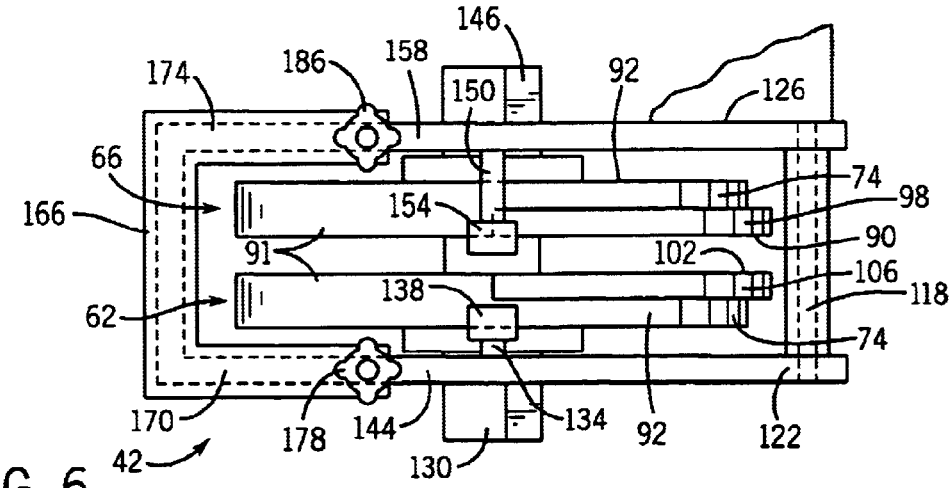
FIG. 6 is a top view of the diameter control mechanism taken along line 6—6 in FIG. 3.

The diameter control mechanism 42 is shown in FIGS. 1, 3, and 6, and includes first and second cam disk assemblies 62 and 66, respectively. FIG. 5 generally illustrates the cam disk assembly 66 which is substantially a mirror image of the cam disk assembly 62. Because the cam disk assemblies 62 and 66 are substantially mirror images of one another, only the cam disk assembly 66 will be described in detail. Like parts are indicated by like reference numerals.

The cam disk assembly 66 includes a base portion 70 having an outer circumferential edge 74 and a central bore 78 for mounting the base portion 70 on a shaft 82 (see FIGS. 1 and 3). The outer circumferential edge 74 is preferably substantially round. The base portion 70 also includes a receiving portion 86 for receiving a cam segment 90. As shown in FIG. 5, the receiving portion 86 is preferably formed by removing an angular segment of the base portion 70. The exact angular dimension of the receiving portion 86 and the corresponding cam segment 90 depends upon the particular coil forming machine 10 being used and can vary from application to application. In one preferred embodiment, the receiving portion 86 and the cam segment 90 extend over approximately 192 degrees, which corresponds to the coil forming period of one operational cycle. In light of the receiving portion 86, the outer circumferential edge 74 has a partial inboard portion 91 and a complete outboard portion 92.

The cam segment 90 is preferably coupled to the base portion 70 using fasteners 94 or any other suitable fastening techniques (i.e., welding). As best seen in FIG. 6, the cam segment 90 includes a cam surface 98 that extends radially outwardly beyond the circumferential edge 74 when the cam segment 90 is coupled to the base portion 70. As will be further described below, the cam surface 98 determines the diameter of the coils 22 being produced. Once a configuration for the cam surface 98 is chosen, all of the coils produced from the cam surface 98 will have a constant coil diameter.

As stated above, the cam disk assembly 62 is substantially a mirror image of the cam disk assembly 66, however, a second and different cam segment 102 is coupled to the base portion 70 of the cam disk assembly 62. The second cam segment 102 has a cam surface 106 that is different from the cam surface 98 to produce a spring coil 22 having a second coil diameter.

The cam disk assemblies 62 and 66 are both mounted for rotation on the shaft 82. A diameter control driving gear 110 is also mounted on the shaft 82 and receives input (either directly or indirectly) from the main coil forming driving device 14 to rotate the shaft 82 and the cam disk assemblies 62 and 66.

As seen in FIGS. 1, 3, and 6, the diameter control mechanism 42 also includes a follower arm assembly 114 that is mounted to the frame 30 adjacent the cam disk assemblies 62 and 66. A follower arm shaft 118 extends from a portion of the frame 30. First and second follower arms 122 and 126, respectively, are mounted on the follower arm shaft 118. The first and second follower arms 122 and 126 can be mounted on the follower arm shaft 118 in any suitable manner and should pivot independently of one another. The first follower arm 122 is preferably mounted to be adjacent and slightly offset to the outboard side of the cam disk assembly 62, and the second follower arm 126 is preferably mounted to be adjacent and slightly offset to the outboard side of the cam disk assembly 66.

The first follower arm 122 includes a first actuator 130 having an actuator shaft 134 and a first cam follower or roller 138 mounted for rotation on the actuator shaft 134. The first actuator 130 operates to move the actuator shaft 134 and the roller 138 axially between an extended position (see FIG. 1) and a retracted position (see FIG. 6). When in the extended position, the roller 138 is positioned to engage and ride on the cam surface 106 and the partial inboard portion 91 of the outer circumferential edge 74. When in the retracted position, the roller 138 is positioned to engage and ride on the complete outboard portion 92 of the circumferential edge 74. The actuator 130 can be any suitable type of pneumatic, hydraulic, mechanical, or electrical actuator and is connected to a control system 142 (shown schematically in FIG. 1). The first follower arm 122 also includes a first follower surface 144, the purpose of which will be described below.

The second follower arm 126 includes a second actuator 146 having an actuator shaft 150 and a second cam follower or roller 154 mounted for rotation on the actuator shaft 150. The second actuator 146 operates to move the actuator shaft 150 and the roller 154 axially between an extended position (see FIG. 6) and a retracted position (see FIG. 1). When in the extended position, the roller 154 is positioned to engage and ride on the cam surface 106 and the partial inboard portion 91 of the outer circumferential edge 74. When in the retracted position, the roller 154 is positioned to engage and ride on the complete outboard portion 92 of the circumferential edge 74. The second actuator 146 can also be any suitable type of pneumatic, hydraulic, mechanical, or electrical actuator and is also connected to the control system 142. The second follower arm 126 also includes a second follower surface 158, the purpose of which will be described below.

The diameter control mechanism 42 further includes a control arm assembly 162 having a forked end 166 including first and second forked arms 170 and 174, respectively. The first forked arm 170 has a first control knob 178 extending therethrough. The first control knob 178 includes a first follower end 182 that engages and rides on the first follower surface 144 of the first follower arm 122. The first control knob 178 is preferably threaded and is adjustable to vary the distance between the forked end 166 and the first follower surface 144.

The second forked arm 174 is substantially identical to the first forked arm 170 and includes a second control knob 186 extending therethrough. The second control knob 186 includes a second follower end 190 that engages and rides on the second follower surface 158 of the second follower arm 126. The second control knob 186 is also preferably threaded and adjustable to vary the distance between the forked end 166 and the second follower surface 158.

The control arm assembly 162 also includes a control arm 194 extending from the forked end 166 toward the diameter control tool 50. The end of the control arm 194 opposite to the forked end 166 is received in a rotation control member 198 that is mounted on a diameter control tool shaft 202. The rotation control member 198 is operable to rotate the diameter control tool shaft 202, thereby imparting rotation on the diameter control tool 50 to vary the diameter of the spring coil 22 being produced.

The diameter control mechanism 42 operates to allow the formation of spring coils 22 having two different spring diameters. The flexibility to form coils of two different diameters comes from the use of the two different cam segments 90 and 102. Once the desired diameters are known, the cam segments 90 and 102 having the desired respective cam surfaces 98 and 106 are attached to the cam disk assemblies 62 and 66.

As the main coil driving device 14 imparts rotation on the shaft 82, the cam disk assemblies 62 and 66 rotate. The control system 142 communicates with the first and second actuators 130 and 146 to position one of the rollers 138 and 154 in the extended position while the other of the rollers 138 and 154 is positioned in the retracted position. As seen in FIG. 6, the roller 154 is extended and the roller 138 is retracted. In this position, the roller 154 is engageable with and rides on both the cam surface 98 and the inboard portion 91 of the outer circumferential edge 74 during rotation of the cam disk assembly 66. The roller 138 is engaged with and rides on the outboard portion 92 of the outer circumferential edge 74 during rotation of the cam disk assembly 62.

Since the outer circumferential edge 74 of both base portions 70 is substantially the same, the cam surface 98 alone dictates the movement of the control arm assembly 162. More specifically, while the roller 138 simply follows the round path of the outboard portion 92, the roller 154 follows both the path defined by the inboard portion 91 and the path defined by the radially offset cam surface 98. Each time the roller 154 engages the cam surface 98, the roller 154 follows the cam surface 98 causing the second follower arm 126 to pivot on the follower arm shaft 118. This pivoting changes the inclination of the second follower surface 158, thereby tending to raise the second control knob 186, which raises the second forked arm 174 and the entire forked end 166. Movement of the forked end 166 moves the control arm 194 to cause rotation of the rotation control member 198 and the diameter control tool shaft 202, thereby imparting rotational adjustment to the diameter control tool 50.

When it is desired to make a spring coil having a second coil diameter, the control system 142 simply causes the second actuator 146 to move the roller 154 to the retracted position and causes the first actuator 130 to move the roller 138 to the extended position as shown in FIG. 1. In this position, the roller 138 is engageable with and rides on both the cam surface 106 and the inboard portion 91 of the outer circumferential edge 74 during rotation of the cam disk assembly 62. The roller 154 is engaged with and rides on the outboard portion 92 of the outer circumferential edge 74 during rotation of the cam disk assembly 66.

Since the outer circumferential edge 74 of both base portions 70 is substantially the same, the cam surface 106 alone dictates the movement of the control arm assembly 162. More specifically, while the roller 154 simply follows the round path of the outboard portion 92, the roller 138 follows both the path defined by the inboard portion 91 and the path defined by the radially offset cam surface 106. Each time the roller 138 engages the cam surface 106, the roller 138 follows the cam surface 106 causing the first follower arm 122 to pivot on the follower arm shaft 118. This pivoting changes the inclination of the first follower surface 144, thereby tending to raise the first control knob 178, which raises the first forked arm 170 and the entire forked end 166.

Presumably, the cam surface 106 will be different than the cam surface 98 such that the movement of the forked end 166 will be of a different magnitude, thereby imparting a substantially different rotational adjustment to the diameter control tool 50 to form a coil spring 22 having a substantially different coil diameter than the coil spring 22 formed based on the movement imparted by the cam surface 98.

It is important to note that the configuration of the diameter control mechanism 42 shown in the figures can be varied as desired. For example, each of the cam disk assemblies 62 and 66 need not consist of a separate base portion and cam segment, but rather could be formed as a single part with a integral cam surface. Additionally, the coil forming machine of the present invention could include more than two cam disk assemblies to allow for the production of coil springs having more than two differing coil diameters. Furthermore, the configurations of the follower arm assembly 114 and the control arm assembly 162 could be altered to fit the specific space constraints of the frame 30.

The diameter control mechanism 42 illustrated in the figures employs two separate actuator/roller units to minimize the problems associated with the selective axial engagement and disengagement of a roller on two substantially different, radially-spaced engagement surfaces. Of course, the diameter control mechanism 42 could also be operable with a single actuator/roller unit that is selectively engageable between the first and second cam disk assemblies 62 and 66.

Figure 4:
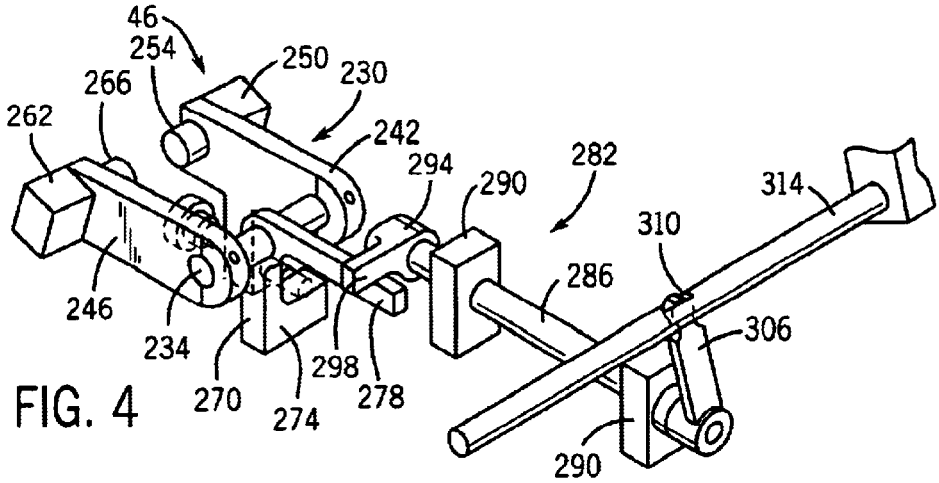
FIG. 4 is a perspective view of a linkage for a pitch control mechanism embodying the invention.

The pitch control mechanism 46 is shown in FIGS. 1, 3, and 4, and includes first and second cam disk assemblies 206 and 210, respectively. The cam disk assemblies 206 and 210 are substantially mirror images of one another and are substantially similar to the cam disk assemblies 62 and 66 with the exception that the cam disk assembly 206 has a cam segment 214 with a cam surface 218, and the cam disk assembly 210 has a cam segment 222 with a cam surface 226. Like parts are indicated by like reference numerals.

The cam disk assemblies 206 and 210 are both mounted for rotation on a shaft 227. A pitch control driving gear 228 (see FIG. 1) is also mounted on the shaft 227 to mesh with the diameter control driving gear 110 and receive input (either directly or indirectly) from the main coil forming driving device 14 to rotate the shaft 227 and the cam disk assemblies 206 and 210.

As seen in FIGS. 1, 4, and 6, the pitch control mechanism 46 also includes a follower arm assembly 230 that is mounted to the frame 30 adjacent the cam disk assemblies 206 and 210. A follower arm shaft 234 is supported in bearing supports 238 (only one shown in FIG. 1). First and second follower arms 242 and 246, respectively, are mounted on the follower arm shaft 234. The first and second follower arms 242 and 246 can be mounted on the follower arm shaft 234 in any suitable manner and can be mounted to pivot independently or as a single unit. In the embodiment illustrated in the figures, the follower arms 242 and 246 are mounted to pivot as a single unit. The first follower arm 242 is preferably mounted to be adjacent and slightly offset to the outboard side of the cam disk assembly 206, and the second follower arm 246 is preferably mounted to be adjacent and slightly offset to the outboard side of the cam disk assembly 210.

The first follower arm 242 includes a first actuator 250 having a first actuator shaft (not shown) and a first cam follower or roller 254 mounted for rotation on the first actuator shaft. The first actuator 250 operates to move the first actuator shaft and the roller 254 axially between an extended position and a retracted position as described above with respect to the first actuator 130. When in the extended position, the roller 254 is positioned to engage and ride on the cam surface 218 and the partial inboard portion 91 of the outer circumferential edge 74. When in the retracted position, the roller 254 is positioned to engage and ride on the complete outboard portion 92 of the circumferential edge 74. The actuator 250 can be any suitable type of pneumatic, hydraulic, mechanical, or electrical actuator and is also connected to the control system 142. The first follower arm 242 also includes a first arm portion 258 and a control knob 259 extending through the first arm portion 258. The control knob 259 is preferably threaded and includes a follower end 260, the purpose of which will be described below.

The second follower arm 246 includes a second actuator 262 having a second actuator shaft (not shown) and a second cam follower or roller 266 mounted for rotation on the second actuator shaft. The second actuator 262 operates to move the second actuator shaft and the roller 266 axially between an extended position and a retracted position as described above with respect to the second actuator 146. When in the extended position, the roller 262 is positioned to engage and ride on the cam surface 226 and the partial inboard portion 91 of the outer circumferential edge 74. When in the retracted position, the roller 266 is positioned to engage and ride on the complete outboard portion 92 of the circumferential edge 74. The second actuator 262 can also be any suitable type of pneumatic, hydraulic, mechanical, or electrical actuator and is also connected to the control system 142.

As best seen in FIGS. 3 and 4, the pitch control mechanism 46 further includes a pivot member 270 pivotally mounted on the follower arm shaft 234. The pivot member 270 includes a lower portion 274 (shown either as a rectangular configuration in FIG. 3 or as an L-shaped configuration in FIG. 4 depending upon the particular configuration of the coil forming machine 10), one side of which is engageable with the follower end 260 of the control knob 259. As stated above, the control knob 259 is preferably threaded and adjustable to vary the distance between the lower portion 274 and the first arm portion 258. The pivot member 270 further includes an upper portion 278 which moves (as shown by the dotted lines in FIG. 3) when the pivot member 270 pivots about the follower arm shaft 234.

The pitch control mechanism 46 further includes a control linkage assembly 282 having a linkage rotation shaft 286 that is supported by two bearing supports 290, which are mounted to the frame 30. The linkage rotation shaft 286 includes a first end 294 adjacent the follower arm assembly 230. The first end 294 includes a first extension member 298 that engages and rests upon the upper portion 278 of the pivot member 270. As the upper portion 278 moves up or down, the first extension member 298 moves up or down and causes rotation of the linkage rotation shaft 286.

The linkage rotation shaft 286 also includes a second end 302 adjacent the pitch control tool 58. The second end 302 includes a second extension member 306 adapted to be received in a slot 310 in a pitch control tool shaft 314. As the linkage rotation shaft 286 rotates, the second extension member 306 causes the pitch control tool shaft 314 to move axially, thereby imparting axial movement of the pitch control tool 58 to vary the pitch of the spring coil 22 being produced.

The pitch control mechanism 46 operates to allow the formation of spring coils 22 having two different spring pitches. The flexibility to form coils having two different pitches comes from the use of the two different cam segments 214 and 222. Once the desired pitches are known, the cam segments 214 and 222 having the desired respective cam surfaces 218 and 226 are attached to the cam disk assemblies 206 and 210.

As the main coil driving device 14 imparts rotation on the shaft 227, the cam disk assemblies 206 and 210 rotate. The control system 142 communicates with the first and second actuators 250 and 262 to position one of the rollers 254 and 266 in the extended position while the other of the rollers 254 and 266 is positioned in the retracted position. The engagement of the rollers 254 and 266 with the cam disk assemblies 206 and 210 is substantially the same as described above with respect to cam disk assemblies 62 and 66 and will not be described in detail again.

Each time the roller 254 engages and follows the cam surface 218, or the roller 266 engages and follows the cam surface 226, the control arm assembly 230 pivots on the control arm shaft 234. This pivoting changes the inclination of the first arm portion 258 such that the follower end 260 of the control knob 259 pushes the lower portion 274 of the pivot member 270 inward. As the lower portion 274 is pushed inward, the pivot member 270 pivots about the control arm shaft 234 and causes the upper portion 278 of the pivot member 270 to raise the first extension member 298 and rotate the linkage rotation shaft 286. The rotation of the linkage rotation shaft 286 causes the second extension member 306 to move the pitch control tool shaft 314 axially outwardly away from the frame 30, thereby imparting axial adjustment to the pitch control tool 58.

Just like with the diameter control mechanism 42, the pitch control mechanism 46 is operable to make spring coils having two different coil pitches. The control system 142 simply causes the actuators 250 and 262 to move the rollers 254 and 266 into or out of engagement with the respective cam surfaces 218 and 226 depending on the pitch desired.

Presumably, the cam surface 218 is different than the cam surface 226 such that the movement of the pivot member 270 will be of a different magnitude depending upon which cam surface 218 or 226 is engaged, thereby imparting a substantially different axial adjustment to the pitch control tool 58. Using the two separate cam segments 214 and 222, the coil forming machine 10 can form coil springs 22 having substantially different coil pitches.

It is important to note that the configuration of the pitch control mechanism 46 shown in the figures can be varied as desired just as described with respect to the diameter control mechanism. For example, each of the cam disk assemblies 206 and 210 need not consist of a separate base portion and cam segment, but rather could be formed as a single part with a integral cam surface. Additionally, the coil forming machine of the present invention could include more than two cam disk assemblies to allow for the production of coil springs having more than two differing coil pitches. Furthermore, the configurations of the follower arm assembly 230 and the control linkage assembly 282 could be altered to fit the specific space constraints of the frame 30.

The pitch control mechanism 46 illustrated in the figures employs two separate actuator/roller units to minimize the problems associated with the selective axial engagement and disengagement of a roller on two substantially different, radially-spaced engagement surfaces. Of course, the pitch control mechanism 46 could also be operable with a single actuator/roller unit that is selectively engageable between the first and second cam disk assemblies 206 and 210.

It should also be mentioned that the coil forming machine 10 of the present invention need not include both the diameter control mechanism 42 and the pitch control mechanism 46 described herein. Rather, the coil forming machine 10 could include only the diameter control mechanism 42 in conjunction with any other pitch controlling mechanism, or alternatively could include only the pitch control mechanism 46 in conjunction with any other diameter controlling mechanism.

Various features of the invention are set forth in the following claims.

What is claimed is:

1. A coil spring forming machine for forming a coil spring having a coil diameter, the forming machine comprising:

a frame;

a diameter control tool movably mounted on the frame; and a diameter control mechanism mounted on the frame and coupled to the diameter control tool, the diameter control mechanism including first and second differently configured cam surfaces and a cam follower assembly, wherein the cam follower assembly includes a shiftable cam follower arrangement having at least one cam follower member and an actuator mechanism, wherein the cam follower arrangement is movable by operation of the actuator mechanism between a first operative position in which the actuator mechanism positions the cam follower member in engagement with the first cam surface and a second operative position in which the actuator mechanism positions the cam follower member in engagement with the second cam surface, wherein the diameter control mechanism is configured to form a coil spring having a first diameter when the cam follower arrangement is in the first operative position and to form a coil spring having a second diameter, different than the first diameter, when the cam follower arrangement is in the second operative position;

wherein the first and second cam surfaces are defined by respective first and second rotatable cam members, wherein each cam member rotates about an axis of rotation, and wherein the at least one cam follower member is movable by operation of the actuator mechanism in a transverse direction parallel to the axis of rotation of the respective first and second rotatable cam members upon movement of the cam follower arrangement between the first and second operative positions.

2. The coil spring forming machine of claim 1, wherein the first and second cam surfaces are defined by respective first and second cam disk assemblies that include respective first and second cam segments, the first cam segment defining the first cam surface and the second cam segment defining the second cam surface.

3. The coil spring forming machine of claim 1, wherein the cam follower arrangement includes a first cam follower member engaged with the first cam surface when the cam follower arrangement is in the first operative position and a second cam follower member engaged with the second cam surface follower arrangement is in the second operative position.

4. The coil spring forming machine of claim 3, wherein the actuator mechanism includes a first actuator interconnected with the first cam follower member that is movable between an extended position and a retracted position in the transverse direction to selectively move the first cam follower member into engagement with the first cam surface, and a second actuator interconnected with the second cam follower member that is movable between an extended position and a retracted position in the transverse direction to selectively move the second cam follower member into engagement with the second cam surface.

5. The coil spring forming machine of claim 3, wherein the first cam follower member is coupled to a first follower arm having a first follower surface and wherein the second cam follower member is coupled to a second follower arm having a second follower surface.

6. The coil spring forming machine of claim 5, wherein the diameter control mechanism further includes a control arm assembly that is moveable in response to movement of the cam follower arrangement, the control arm assembly having first and second arms, the first arm having a control knob engageable with the first follower surface and the second arm having a control knob engageable with the second follower surface.

7. The coil spring forming machine of claim 6, wherein the control arm assembly further includes a control arm coupled on one end to each of the first and second arms and coupled on the other end to the diameter control tool to move the diameter control tool and vary the coil diameter in response to movement of the first and second follower arms.

8. A coil spring forming machine for forming a coil spring having a coil pitch, the forming machine comprising:

a frame;

a pitch control tool movably mounted on the frame; and a pitch control mechanism mounted on the frame and coupled to the pitch control tool, the pitch control mechanism operable to move the pitch control tool to vary the coil pitch, the pitch control mechanism including first and second differently configured cam surfaces and a cam follower assembly, wherein the cam follower assembly includes a shiftable cam follower arrangement including at least one cam follower member and an actuator mechanism, wherein the cam follower arrangement is movable by operation of the actuator mechanism between a first operative position in which the actuator mechanism positions the cam follower member in engagement with the first cam surface and a second operative position in which the actuator mechanism positions the cam follower member in engagement with the second cam surface;

wherein the first and second cam surfaces are defined by respective first and second rotatable cam members, wherein each cam member rotates about an axis of rotation, and wherein the first and second cam follower members are movable by operation of the actuator mechanism in a transverse direction parallel to the axis of rotation of the respective first and second rotatable cam members upon movement of the cam follower arrangement between the first and second operative positions.

9. The coil spring forming machine of claim 8, wherein the first and second cam surfaces are defined by respective first and second disk assemblies that include respective first and second cam segments, the first cam segment defining the first cam surface and the second cam segment defining the second cam surface.

10. The coil spring forming machine of claim 8, wherein th cam follower arrangement includes a first cam follower member engaged with the first cam surface when the cam follower arrangement is in the first operative position and a second cam follower member engaged with the second cam surface when the cam follower arrangement is in the second operative position.

11. The coil spring forming machine of claim 10, wherein the actuator mechanism includes a first actuator interconnected with the first cam follower member that is movable between an extended position and a retracted position in the transverse direction to selectively move the first cam follower member into engagement with the first cam surface, and a second actuator interconnected with the second cam follower member that is movable between an extended position and a retracted position in the transverse direction to selectively move the second cam follower member into engagement with the second cam surface.

12. The coil spring forming machine of claim 10, wherein the first cam follower member is coupled to a first follower arm having an arm portion that supports a control knob and wherein the second cam follower member is coupled to a second follower arm.

13. The coil spring forming machine of claim 12, wherein the pitch control mechanism further includes a pivot member that is pivotable in response to movement of the cam follower arrangement, the pivot member having a portion that is engageable with the control knob.

14. The coil spring forming machine of claim 13, wherein the pitch control mechanism further includes a linkage assembly coupled on one end to the pivot member and coupled on the other end to the pitch control tool to move the pitch control tool and to vary the coil pitch in response to movement of the pivot member.

15. A coil spring forming machine for forming a coil spring having a dimensional characteristic, the forming machine comprising:

a frame;

a control tool movably mounted on the frame; and a control mechanism mounted on the frame and coupled to the control tool, the control mechanism operable to move the control tool to vary the dimensional characteristic, the control mechanism including first and second cam surfaces defined by respective first and second rotatable cam members, each of which rotates about an axis of rotation, and a shiftable cam follower arrangement selectively engageable with either of the first and second cam surfaces, wherein the cam follower arrangement includes at least one cam follower member and an actuator mechanism, wherein the cam follower arrangement is movable by operation of the actuator mechanism between a first operative position in which the actuator mechanism positions the cam follower member in engagement with the first cam surface, and a second operative position in which the actuator mechanism positions the cam follower member in engagement with the second cam surface;

wherein the first and second cam surfaces are defined by respective first and second rotatable cam members, wherein each cam member rotates about an axis of rotation, and wherein the cam follower member is movable by operation of the actuator mechanism in a transverse direction parallel to the axis of rotation of the respective first and second rotatable cam members upon movement of the cam follower arrangement between the first and second operative positions.

16. The coil spring forming machine of claim 15, wherein the dimensional characteristic is the coil diameter.

17. The coil spring forming machine of claim 15, wherein the dimensional characteristic is the coil pitch.

18. The coil spring forming machine of claim 15, wherein the actuator mechanism includes a first actuator mechanism interconnected with the first cam follower member and a second actuator mechanism interconnected with the second cam follower member, wherein, when the cam follower arrangement is in the first operative position, the first actuator mechanism is operated so as to position the first cam follower member in engagement with the first cam surface and the second actuator mechanism is operated so as to position the second cam follower member out of engagement with the second cam surface, and wherein, when the cam follower arrangement is in the second operative position, the second actuator mechanism is operated so as to position the second cam follower member in engagement with the second cam surface and the first actuator mechanism is operated so as to position the first cam follower member out of engagement with the first cam surface.

19. A method of varying a dimensional characteristic of consecutively produced coil springs in a coil forming machine having a control tool, the method comprising:

coupling a control mechanism to the control tool, the control mechanism including first and second cam surfaces defined by respective first and second rotatable cam members, each of which is rotatable about an axis of rotation, and a cam follower assembly including at least one cam follower member interconnected with an actuator, wherein the actuator is operable to selectively engage the at least one cam follower with either the first cam surface or the second cam surface;

forming a first coil spring while the cam follower assembly is in a first operative position in which the cam follower member is engaged with the first cam surface;

moving the cam follower assembly away from the first operative position to a second operative position, wherein the cam follower member is moved out of engagement with the first cam surface by operation of the actuator to a second operative position in which the cam follower member is moved into engagement with the second cam surface by operation of the actuator;

wherein the actuator is configured and arranged to move the respective cam follower member in a direction parallel to the axis of rotation of the respective first and second cam members upon movement of the cam follower assembly between the first operative position and the second operative position; and forming a second coil spring while the cam follower assembly is in the second operative position.

20. The method of claim 19, wherein the dimensional characteristic is the coil diameter, wherein the control tool is a diameter control tool, and wherein the control mechanism is a diameter control mechanism.

21. The method of claim 19, wherein the dimensional characteristic is the coil pitch, wherein the control tool is a pitch control tool, and wherein the control mechanism is a pitch control mechanism.

* * * * *

UNITED STATES PATENT AND TRADEMARK OFFICE

CERTIFICATE OF CORRECTION

PATENT NO. : 6,758,079 B2
DATED : July 6, 2004
INVENTOR(S) : David Scott Wells et al.

It is certified that error appears in the above-identified patent and that said Letters Patent is hereby corrected as shown below:

Column 10,
Line 18, after "surface" insert -- when the cam --.

Signed and Sealed this

Seventh Day of September, 2004

JON W. DUDAS
*Director of the United States Patent and Trademark Office*